US006720293B2

(12) United States Patent
Bovington et al.

(10) Patent No.: US 6,720,293 B2
(45) Date of Patent: Apr. 13, 2004

(54) LOW VISCOSITY LUBRICATING OIL COMPOSITIONS

(75) Inventors: Charles H. Bovington, Oxfordshire (GB); Christopher J. Locke, Oxon (GB); Terence Kelly, Oxon (GB)

(73) Assignee: Infineum International Ltd. (GB)

( * ) Notice: Subject to any disclaimer, the term of this patent is extended or adjusted under 35 U.S.C. 154(b) by 102 days.

(21) Appl. No.: 09/961,866

(22) Filed: Sep. 24, 2001

(65) Prior Publication Data

US 2002/0058593 A1 May 16, 2002

(30) Foreign Application Priority Data

Sep. 25, 2000 (EP) ..... 00203302
May 29, 2001 (EP) ..... 01304704

(51) Int. Cl.[7] ..... C10M 141/00; C10M 141/06

(52) U.S. Cl. ..... 508/192; 508/287; 508/371; 508/373; 508/375; 508/390; 508/502; 508/539; 508/586

(58) Field of Search ..... 508/192, 287

(56) References Cited

U.S. PATENT DOCUMENTS 4,938,880 A * 7/1990 Waddoups et al. ..... 252/32.7 E
5,523,007 A 6/1996 Kristen et al. ..... 252/32.7 E
5,525,247 A * 6/1996 Miyaji et al. ..... 252/18
5,558,802 A 9/1996 Dowling ..... 508/391
5,672,570 A 9/1997 Miyaji et al. ..... 508/192
5,719,107 A 2/1998 Outten et al. ..... 508/185
5,744,430 A * 4/1998 Inoue et al. ..... 508/295
5,958,848 A * 9/1999 Robson ..... 508/232
6,103,672 A 8/2000 Dunn et al. ..... 508/185
6,423,670 B2 * 7/2002 Locke et al. ..... 508/192

FOREIGN PATENT DOCUMENTS

EP 0 839 894 A1 5/1998 ..... C10M/163/00

* cited by examiner

*Primary Examiner*—Ellen M McAvoy

(57) ABSTRACT

A low viscosity lubricating oil composition having a CCS viscosity less than 3500 mPa.s at −25° C. and having no more than 0.16 mass % of phosphorus which comprises a dispersant, and a detergent of calcium or magnesium or both; and optionally a zinc dihydrocarbyldithiophosphate, a viscosity modifier, a pour point depressant and an antioxidant. The oil satisfies the Cummins M11 cross-head wear engine test specification in a low phosphorus and low viscosity formulation.

11 Claims, 1 Drawing Sheet

LOW VISCOSITY LUBRICATING OIL COMPOSITIONS

Figure 1:
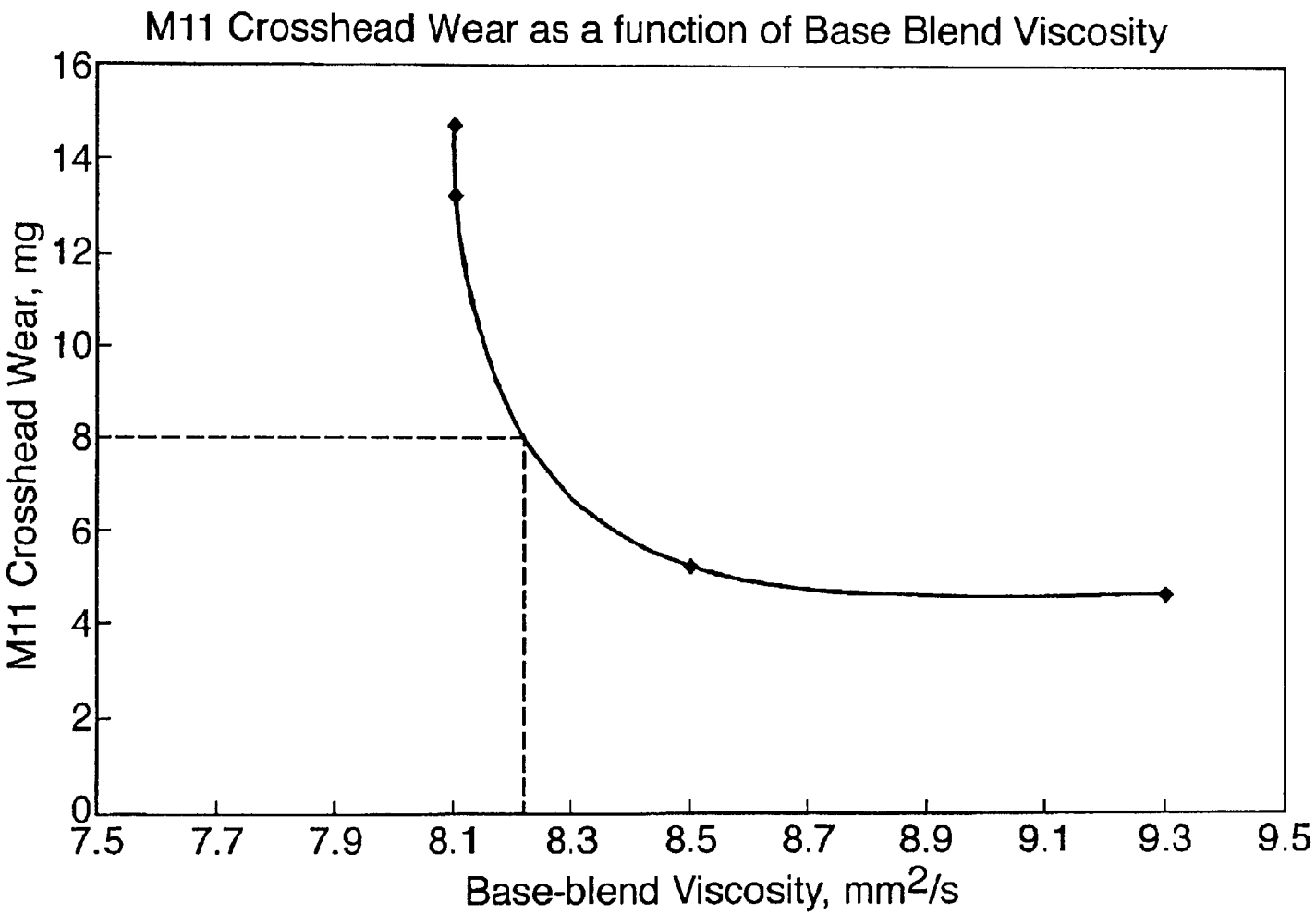

The present invention relates to a low viscosity crankcase lubricant, i.e., SAE J300 classification of 0W or 5W, which exhibits superior performance properties in combustion engines, preferably diesel (compression ignited) engines, especially in heavy duty (HD) diesel engines. Such lubricants may also be referred to as lubricating oils, lubricating oil compositions, and lubricating oil formulations.

The heavy duty trucking market has come to adopt the diesel engine as its preferred power source due to both its excellent longevity and its economy of operation. Specialized lubricants have been developed to meet the more stringent performance requirements of HD diesel engines compared with passenger car engines.

Several engine tests are required to demonstrate satisfactory HD performance, including the Cummins M11 test to evaluate soot-related valve train wear, filter plugging and sludge.

There is a need in the art for low viscosity lubricating oils that are capable of meeting the HD diesel requirements. Surprisingly, a low viscosity lubricating oil which affords improved performance in the Cummins M11 test has now been discovered.

The present invention is based on the discovery that low viscosity lubricating oil compositions, such as heavy duty (HD) diesel lubricating oil compositions, can be successfully formulated provided that the base blend viscosity of the components that exhibit Newtonian behaviour is at least 8.2, such as from 8.2 to 30, preferably 8.2 to 10, $mm^2s^{-1}$ at 100° C.

Thus, in a first aspect, the present invention provides a low viscosity lubricating oil composition, preferably a diesel engine lubricating oil composition, more preferably a heavy duty diesel engine lubricating oil composition, having a CCS viscosity less than 3500 mPa.s at −25° C. and a sulfated ash value of up to 2.0 mass %, based on the mass of the oil composition, which composition comprises an admixture of:

(a) 1 to 10 mass % of a dispersant, based on the mass of the oil composition;

(b) 0.05 to 0.60 mass % of elemental calcium or 0.05 to 0.30 mass % of elemental magnesium or both the calcium and magnesium in the corresponding amounts, based on the mass of the oil composition, wherein the calcium or magnesium or both calcium and magnesium are derived from one or more detergents;

(c) 0 to 0.16 mass %, based on the mass of the oil composition, of phosphorus, preferably derived from a zinc dihydrocarbyl dithiophosphate;

(d) 0 to 5 mass % of an antioxidant, based on the mass of the oil composition;

(e) 0 to 2 mass % of a pour depressant, based on the mass of the oil composition;

(f) 0 to 2 mass % of a viscosity modifier, expressed as solid polymer, based on the mass of the oil composition; and (g) the balance a lubricating oil basestock selected from the group consisting of Group I, II, III, IV IV, V basestocks and any mixture thereof, with the proviso that when all the components, which exhibit Newtonian behaviour, are admixed together, the base blend viscosity of the resulting admixture or composition is at least 8.2 $mm^2s^{-1}$ at 100° C.

For the avoidance of doubt, components (c), (d), (e) and (f) can be optional.

In a second aspect, the present invention provides a method for preparing the lubricating oil composition of the first aspect which comprises the steps of selecting components (a) to (g) so as to provide a composition having a base blend viscosity, as defined in the first aspect, of at least 8.2 $mm^2s^{-1}$ at 100° C., and thereafter admixing the components so as to provide a lubricating oil composition having a CCS viscosity of less than 3500 mPa.s at −25° C.

In a third aspect, the present invention provides a method of lubricating an engine, preferably a diesel engine, especially a heavy duty engine, which comprises supplying to the engine a lubricating oil composition of the first aspect.

In a fourth aspect, the present invention provides the use of a lubricating oil composition of the first aspect for meeting the requirements in the M11 cross-head wear engine test.

In a fifth aspect, the present invention provides a method of meeting the requirements of the M11 cross-head wear engine test, which comprises using a lubricating oil composition of the first aspect in the test.

As used herein, all mass % numbers are on an active ingredient (a.i.) basis unless otherwise noted, and a.i. refers to the additive material which is not diluent or carrier oil.

As used herein, the term "base blend viscosity" refers to the viscosity, measured according to ASTM D445, of a composition comprising, or an admixture of, components that exhibit Newtonian behaviour, which in the present invention are all the components (including the carrier oil such as the basestock) but excluding the solid polymer or 'active ingredient' of the viscosity modifier, which is considered not to exhibit Newtonian behaviour. Thus, the base blend viscosity can refer to the viscosity of a composition comprising the basestock oil, the dispersant, the detergent, the ZDDP, the antioxidant, all carrier oils and diluent oils of the components, the pour depressant and any other components which exhibit Newtonian behaviour, such as antifoamants.

According to the present invention, it is found that if the base blend viscosity parameter is satisfied, and if the CCS viscosity of the lubricating oil composition, which may comprise a viscosity modifier, is less than 3500 mPa.s at −25° C., then the composition will pass the Cummins M11 200 hour cross-head wear test, which satisfies ACEA E5 and API CH-4 specification limits.

Computer modeling systems may also be employed to predict the base blend viscosity of a lubricating oil composition based on the viscosity of the components present therein.

It will be understood that the additives of the composition may react under the conditions of formulation, storage, or use and that the present invention also extends to the product obtainable or obtained as a result of any such reaction.

In a preferred aspect of the present invention, the oil composition of the present invention has less than 1.5% of ash, preferably less than 1.25%, especially less than 1% of ash, such as in the range from 0 to 0.5% ash, according to method ASTM D874.

Preferably the amount of phosphorus in the lubricating oil composition is 0 to 0.14 or 0.12, especially less than 0.09, less than 0.08, less than 0.07 or less than 0.06, mass %; more preferably at most 0.05, at most 0.04 or at most 0.03, mass %; such as in the range from 0.001 to 0.03 mass %; for example at most 0.02, or at most 0.01, mass %. In a preferred embodiment, the phosphorus content is zero in the lubricating oil composition.

Preferably, the lubricating oil composition contains, independent of the amount of phosphorus, 0 to 2, preferably at most 1.5, such as at most 1, mass %, based on the mass of the oil composition, of sulfur. In a preferred aspect, the amount of sulfur is at most 0.4, at most 0.3 or at most 0.25, mass %; especially at most 0.2, or at most 0.15, mass %; such as in the range from 0.001 to 0.1 mass %. In a more preferred aspect, the sulfur content is zero in the lubricating oil composition.

The amount of elemental phosphorus and sulfur in the lubricating oil composition is measured according to ASTM D5185.

The components of the invention will now be discussed in further detail as follows.

Dispersant (a)

The dispersant comprises an oil-soluble polymeric hydrocarbon backbone having functional groups that are capable of associating with particles to be dispersed.

Dispersants are preferably present in amounts of from 1 to 7, more preferably 1.5 to 6.5, such as 3 to 6 or 5, mass %. Typically, the dispersants comprise amine, alcohol, amide, or ester polar moieties attached to the polymer backbone often via a bridging group. The dispersant may be, for example, selected from oil-soluble salts, esters, amino-esters, amides, imides, and oxazolines of long chain hydrocarbon substituted mono- and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine, and Koch reaction products.

The oil-soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil-soluble polymeric hydrocarbon backbone may be a homopolymer (e.g., polypropylene or polyisobutylene) or a copolymer of two or more of such olefins (e.g., copolymers of ethylene and an alpha-olefin such as propylene and butylene or copolymers of two different alpha-olefins).

One preferred class of olefin polymers is polybutenes and specifically polyisobutenes (PIB) or poly-n-butenes, such as may be prepared by polymerization of a $C_4$ refinery stream. Another preferred class of olefin polymers is ethylene alpha-olefin (EAO) copolymers or alpha-olefin homo- and copolymers such as may be prepared using metallocene chemistry having in each case a high degree (e.g. >30%) of terminal vinylidene unsaturation.

The oil-soluble polymeric hydrocarbon backbone will usually have number average molecular weight ($\overline{M}n$) within the range of from 300 to 20,000. The $\overline{M}n$ of the backbone is preferably within the range of 500 to 10,000, more preferably 700 to 5,000, where the use of the backbone is to prepare a component having the primary function of dispersancy. Hetero-polymers such as polyepoxides are also usable to prepare components. Both relatively low molecular weight ($\overline{M}n$ 500 to 1500) and relatively high molecular weight ($\overline{M}n$ 1500 to 5,000 or greater) polymers are useful to make dispersants. Particularly useful olefin polymers for use in dispersants have $\overline{M}n$ within the range of from 900 to 3000. Where the component is also intended to have a viscosity modification effect, it is desirable to use higher molecular weight, typically with $\overline{M}n$ of from 2,000 to 20,000, and, if the component is intended to function primarily as a viscosity modifier, the molecular weight may be even higher with an $\overline{M}n$ of from 20,000 up to 500,000 or greater. The functionalized olefin polymers used to prepare dispersants preferably have approximately one terminal double bond per polymer chain.

The $\overline{M}n$ for such polymers can be determined by several known techniques. A convenient method for such determination is by gel permeation chromatography (GPC) which additionally provides molecular weight distribution information.

The oil-soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil-soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer allylic to the olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction in the absence of halogenation; reaction of the polymer with at least one phenol group (this permits derivatization in a Mannich base-type condensation); reaction of the polymer at a point of unsaturation with carbon monoxide using a hydroformylation catalyst or a Koch-type reaction to introduce a carbonyl group attached to a —$CH_2$— or in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitrites, and imidazoline groups. Particularly useful amine compounds include mono- and polyamines, e.g. polyalkylene and polyoxyalkylene polyamines of 2 to 60, conveniently 2 to 40 (e.g., 3 to 20), total carbon atoms and 1 to 12, conveniently 3 to 12, preferably 3 to 9, nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,3-propylene) triamine.

A preferred group of dispersants includes those substituted with succinic anhydride groups and reacted with polyethylene amines (e.g., tetraethylene pentamine), aminoalcohols such as trismethylolaminomethane, polymer products of metallocene catalyzed polymerisations, and optionally additional reactants such as alcohols and reactive metals e.g., pentaerythritol, and combinations thereof. Also useful are dispersants wherein a polyamine is attached directly to the backbone by the methods shown in U.S. Pat. Nos. 5,225,092, 3,275,554 and 3,565,804 where a halogen group on a halogenated hydrocarbon is displaced with various alkylene polyamines.

Another class of dispersants comprises Mannich base condensation products. Generally, these are prepared by condensing one mole of an alkyl-substituted mono- or polyhydroxy benzene with 1 to 2.5 moles of carbonyl compounds (e.g., formaldehyde and paraformaldehyde) and 0.5 to 2 moles polyalkylene polyamine as described, for example, in U.S. Pat. No. 3,442,808.

The dispersant can be further post-treated by a variety of conventional post treatments such as boration, as generally described in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids or highly borated low $\overline{M}w$ dispersant, in an amount to provide a boron to nitrogen mole ratio of 0.01–5.0. Usefully the dispersants contain from about 0.05 to 2.0, e.g. 0.05 to 0.7, mass % boron based on the total mass (active ingredient basis) of the borated acyl nitrogen compound.

Preferably the dispersant is a so-called ashless dispersant, which are organic materials which form substantially no ash on combustion, in contrast to metal-containing (and thus ash-forming) detergents. Borated metal-free dispersants are also regarded herein as ashless dispersants.

Preferred for use in the invention is a polyisobutenyl succinimide dispersant wherein the Mn of the polyisobutenyl groups is from 950 to 3000, such as 900 to 1200 or 2000 to 2300, or a borated derivative thereof which contains not more than 0.2, such as not more than 0.1, for example 0.01 to 0.1, mass % boron, as elemental boron.

Detergent (b)

Detergents generally comprise a polar head with a long hydrophobic tail, with the polar head comprising a metal salt of an acidic organic compound, such as sulfonic acid, salicylic acid, carboxylic acid, phenol or any derivatives thereof. The metal salt of the organic acid is often referred to as a surfactant.

The detergent of the present invention may be a salt of one type of organic acid or a salt of more than one type of organic acid, for example hybrid detergents. Preferably, the detergent is a salt of one type of organic acid. In the instance where more than one type of organic acid is present in a single detergent, the proportion of any one type of organic acid to another is not critical.

Preferably, the detergent is selected from the group consisting of a sulfonate, a phenate, a carboxylate, a salicylate, and mixtures thereof.

It is possible to include large amounts of a metal base in the detergent by reacting an excess of a metal compound such as an oxide or hydroxide with an acidic gas such as carbon dioxide. The resulting overbased detergent comprises the neutral detergent (i.e. the metal salt of the organic acid) as the outer layer of a metal base (e.g. carbonate) micelle. Such overbased detergents may have a TBN of 150 or greater, and typically of from 250 to 450 or more.

The detergent according to the present invention may be neutral or overbased. The terms neutral and overbased with respect to detergents is well known in the art.

Preferably at least one of the detergents, whether calcium or magnesium, is an overbased detergent; especially preferred is a calcium overbased detergent.

The detergents can have a Total Base Number (TBN) in the range of 15 or 60 to 600, preferably 100 to 450, more preferably 160 to 400. TBN is measured according to ASTM D-2896.

Calcium or magnesium phenates are calcium or magnesium salts of phenols and sulfurized phenols and are prepared by reaction with an appropriate metal compound such as an oxide or hydroxide; the neutral or overbased products may be obtained by methods well known in the art. Sulfurised phenols may be prepared by reacting a phenol with sulfur or a sulfur-containing compound such as hydrogen sulfide, sulfur monohalide or sulfur dihalide, to form products which are generally mixtures of compounds in which two or more phenols are bridged by sulfur-containing bridges.

Calcium or magnesium sulfonates function both as detergents to reduce or remove deposits and as acid neutralizers or rust inhibitors, thereby reducing wear and corrosion and extending engine life.

Sulfonates may be prepared from sulfonic acids, which are typically obtained by the sulfonation of alkyl-substituted aromatic hydrocarbons such as those obtained from the fractionation of petroleum, or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from 3 to more than 70 carbon atoms. The alkaryl sulfonates usually contain from 9 to 80 or more, preferably from 16 to 60, carbon atoms per alkyl-substituted aromatic moiety.

The oil-soluble sulfonates or alkyl aryl sulfonic acids may be neutralized with oxides, hydroxides, alkoxides, carbonates, carboxylates, sulfides, hydrosulfides, nitrates, borates and ethers of the metal. The amount of metal compound is chosen having regard to the desired TBN of the final product but typically ranges from about 125 to 220 mass % of that stoichiometrically required.

Preferred are oil-soluble overbased calcium and magnesium sulfonates having TBN of 300 to 400; and mixtures of calcium sulfonates of TBN 250 to 400, e.g., TBN of 300, with calcium phenates or sulfurized phenates of TBN 100 to 300, such as 150.

The detergent may also be an oil-soluble calcium or magnesium hydrocarbyl substituted salicylate. The hydrocarbyl substituent of the hydrocarbyl-substituted salicylate and their sulphurized derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerization of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

The TBN of the calcium or magnesium salicylate may be in the range from 10 to 400. A mixture of two calcium alkyl salicylates having TBN of 50 to 300 such as a TBN of 58 and 160 has been found to be effective in the present invention.

Calcium and magnesium salts of carboxylic acids include mono- and dicarboxylic acids. Preferred monocarboxylic acids are those containing 8 to 30 carbon atoms, especially 8 to 24 carbon atoms. (Where this specification indicates the number of carbon atoms in a carboxylic acid, the carbon atom(s) in the carboxylic group(s) is/are included in that number). Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the α-carbon atom and dicarboxylic acids with 2 or more carbon atoms separating the carboxylic groups. Further, dicarboxylic acids with more than 35 carbon atoms, for example, 36 to 100 carbon atoms, are also suitable. Unsaturated carboxylic acids can be sulphurized.

Preferably the lubricating oil composition of the present invention has, independent of the amount of elemental magnesium, 0.15 to 0.6, especially 0.25 to 0.55, such as in the range of from 0.4 to 0.55, mass % of elemental calcium, based on the mass of the lubricating oil composition.

Preferably the lubricating oil composition of the present invention has, independent of the amount of calcium, 0.05 to 0.15, especially 0.05 to 0.1, mass % of elemental magnesium, based on the mass of the lubricating oil composition.

In each aspect of the present invention, it is preferred that the lubricating oil composition has a calcium detergent so that calcium is present in the amount defined above, and optionally a magnesium detergent so that magnesium is present in the amount defined above.

In each aspect of the present invention, it is preferred that at least one detergent, especially each detergent, comprises calcium; advantagesously at least one detergent, more advantageously each detergent, is a calcium overbased detergent. Therefore, the amount of calcium detergent corresponds to the amount required for the amount of calcium defined above.

In each aspect of the present invention, it is preferred that the detergent comprises a mixture of a calcium sulfonate and a calcium phenate, or at least one calcium alkyl salicylate. More preferably each detergent is a calcium alkyl salicylate.

Phosphorus-Containing Compound (c)

The phosphorus-containing compound may be metallic (i.e. ash forming) or ashless. Typically such compounds are suitable for anti-wear and anti-oxidant effects.

Dihydrocarbyl dithiophosphate metal salts are frequently used as anti-wear and antioxidant agents.

The compositions of this invention preferably contain a zinc dihydrocarbyl dithiophosphate (ZDDP), if a phosphorus-containing compound is present, in an amount such that up to 0.16 mass % of phosphorus derived from ZDDP is present in the finished lubricating oil composition. Preferably, the amount of ZDDP is such as to provide 0 to 0.14 mass % or 0.12 mass % of phosphorus, especially less than 0.09, less than 0.08, less than 0.07 or less than 0.06 mass % of phosphorus; more preferably at most 0.05, at most 0.04 or at most 0.03 mass % of phosphorus; such as in the range from 0.001 to 0.03 mass % of phophorus; for example at most 0.02 or at most 0.01 mass % of phosphorus.

The ZDDP may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used, but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil-soluble salts of dihydrocarbyl dithiophosphoric acids and may be represented by the following formula:

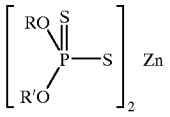

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil-solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 mole % of the alcohols used to introduce hydrocarbyl groups into the dithiophosphoric acids are secondary alcohols.

Greater percentages of secondary alcohols are preferred, and may be required in particularly high nitrogen systems. Thus, the alcohols used to introduce the hydrocarbyl groups may be 60 or 75 mole % secondary. Most preferably, the hydrocarbyl groups are more than 90 mole % secondary.

Sulfur- and molybdenum-containing compounds are also examples of anti-wear additives.

Also suitable are ashless phosphorus- and sulfur-containing compounds. Examples of ashless phosphorus-containing compounds are organophospites and ashless dithiophosphates.

Antioxidant (d)

The lubricant of this invention may include 0 to 5 or 3, preferably 0.0 to 2.0, mass % of an antioxidant; such as 0.2 or 0.5 to 1.5 mass % of an antioxidant. Suitable compounds include hindered phenols which are oil-soluble phenols substituted at one or both ortho positions, such as the monohydric and mononuclear phenols such as 2,6-di-tertiary alkylphenols (e.g. 2,6-di-t-butylphenol, 2,4,6-tri-t-butyl phenol, 2-t-butyl phenol, 4-alkyl, 2,6-t-butyl phenol, 2,6-di-isopropylphenol, and 2,6-dimethyl, 4-t-butyl phenol). Other suitable hindered phenols include polyhydric and polynuclear phenols such as alkylene-bridged hindered phenols (4,4'-methylenebis(6-tert-butyl-o-cresol), 4,4'-methylenebis(2-tert-amyl-o-cresol), and 2,2'-methylenebis (2,6-di-t-butylphenol). The hindered phenol may be borated or sulfurized. Preferred hindered phenols have good oil-solubility and relatively low volatility.

Other antioxidants which may be used in lubricating oil compositions include oil-soluble copper compounds. The copper may be blended into the oil as any suitable oil-soluble copper compound. By oil-soluble it is meant that the compound is oil-soluble under normal blending conditions in the oil or additive package. The copper may, for example, be in the form of a copper dihydrocarbyl thio- or dithiophosphate. Alternatively, the copper may be added as the copper salt of a synthetic or natural carboxylic acid, for example, a $C_8$ to $C_{18}$ fatty acid, an unsaturated acid, or a branched carboxylic acid. Also useful are oil-soluble copper dithiocarbamates, sulphonates, phenates, and acetylacetonates. Examples of particularly useful copper compounds are basic, neutral or acidic copper $Cu^{I}$ and/or $Cu^{II}$ salts derived from alkenyl succinic acids or anhydrides.

Copper antioxidants will generally be employed in an amount of from about 5 to 500 ppm by weight of the copper, in the final lubricating composition.

Metallic dithiocarbamates (for example molybdenum dithiocarbamates), ashless dithiocarbamates, metal dithiophosphates, other than zinc, and organo-sulfur compounds are also examples of antioxidants.

Preferably the antioxidant is an ashless antioxidant. Examples of suitable ashless antioxidants also include oil soluble aromatic amines such as $C_6$–$C_{16}$ dialkyl diphenyl amines, especially dinonyl diphenyl amine.

Pour Depressant (e)

Pour depressants, preferably present in an amount of 0.1 to 2 or 1 mass %, otherwise known as lube oil flow improvers, lower the minimum temperature at which the fluid will flow or can be poured. Such additives are well-known. Typical of those additives which improve the low temperature fluidity of the fluid are $C_8$ to $C_{18}$ dialkyl fumarate/vinyl acetate copolymers and polyalkylmethacrylates. Likewise, the dialkyl fumarate and vinyl acetate may be used as compatibilizing agents.

Viscosity Modifier (f)

The viscosity modifier (VM) functions to impart high and low temperature operability to lubricating oil. The VM used may have that sole function, or may be multifunctional. Multifunctional viscosity modifiers that also function as dispersants are also known.

Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene. Preferred are hydrogenated styrene-isoprene copolymers and hydrogenated isoprene polymers.

Some of the above-mentioned additives can provide a multiplicity of effects; thus for example, a single additive may act as a dispersant-oxidation inhibitor. This approach is well known and does not require further elaboration. It is important to note that addition of the other components noted above must comply with the limitations set forth herein.

Preferably the viscosity modifier is present in an amount of 0.1 to 1.5 mass % expressed as solid polymer or active ingredient, such as 0.5 to 1.0 mass %, based on the mass of the lubricating oil composition.

Numerous other additives may be present as optional ingredients in the composition of this invention and these are listed below.

Rust inhibitors selected from the group consisting of nonionic polyoxyalkylene polyols and esters thereof, polyoxyalkylene phenols, and anionic alkyl sulfonic acids may be used.

Copper- and lead-bearing corrosion inhibitors may be used, but are typically not required with the formulation of the present invention. Typically such compounds are the thiadiazole polysulfides containing from 5 to 50 carbon atoms, their derivatives and polymers thereof. Other additives are the thio and polythio sulfenamides of thiadiazoles. Benzotriazoles derivatives also fall within this class of additives. When these compounds are included in the lubricating composition, they are preferably present in an amount not exceeding 0.2 mass %.

A small amount of a demulsifying component may be used. A preferred demulsifying component is obtained by reacting an alkylene oxide with an adduct obtained by reacting a bis-epoxide with a polyhydric alcohol. The demulsifier should be used at a level not exceeding 0.1, conveniently 0.001 to 0.05, mass %.

Incompatibility may occur when certain types of polymers for use in the manufacture of motor oil viscosity modifiers are dissolved in basestock. An uneven molecular dispersion of polymer which gives the mixture either a tendency to separate or a grainy appearance ensues. The problem is solved by using a compatibility agent having a hydrocarbon group attached to a functional group that serves to break up or prevent packing.

Foam control can be provided by many compounds including an antifoamant of the polysiloxane type, for example, silicone oil or polydimethyl siloxane.

Basestock (g)

The oil compositions of this invention can employ a synthetic or mineral oil basestock of lubricating viscosity selected from the group consisting of Group I, II, III, IV and V basestocks and mixtures of thereof.

Basestocks may be made using a variety of different processes including but not limited to distillation, solvent refining, hydrogen processing, oligomerization, esterification, and rerefining.

API 1509 "Engine Oil Licensing and Certification System" Fourteenth Edition, December 1996 states that all basestocks are divided into five general categories:

Group I contain less than 90% saturates and/or greater than 0.03% sulfur and have a viscosity index greater than or equal to 80 and less than 120;

Group II contain greater than or equal to 90% saturates and less than or equal to 0.03% sulfur and have a viscosity index greater than or equal to 80 and less than 120;

Group III contain greater than or equal to 90% saturates and less than or equal or 0.03% sulfur and have a viscosity index greater than or equal to 120;

Group IV are polyalphaolefins (PAO); and

Group V include all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

The basestock can be from Group I, II, III, IV or V, or any mixture thereof. Indeed, basestocks suitable in the present invention include basestocks of different viscosities within the same group, for example, a basestock mixture of Group IV having 6 $mm^2s^{-1}$ at 100° C. and Group IV having 4 $mm^2s^{-1}$ at 100° C.

Preferably, the basestock is selected from (a) a Group IV, (b) a Group III, (c) a mixture a Groups IV and V, (d) a mixture of Groups III and IV, (e) a mixture of Groups III and V, (f) mixture of Groups III, IV and IV. The amount of Group V basestock in the mixture is typically up to 30 mass %, based on the mass of the basestock. The basestock can also contain up to 20 mass %, based on the mass of the basestock, of Group I and Group II basestocks.

The viscosity of the basestock, irrespective of whether it is a mixture, can be in the range from 3 to 9, preferably 2.5 to 7.5, more preferably 4.5 to 7, especially from 5 to 6, $mm^2s^{-1}$ at 100° C.

Group IV basestocks, i.e. polyalphaolefins (PAO), include hydrogenated oligomers of an alpha-olefin, the most important methods of oligomerization being free radical processes, Ziegler catalysis, cationic, and Friedel-Crafts catalysis. The polyalphaolefins (PAO) typically have viscosities in the range of 2 to 20 at 100° C.

Preferred are Group IV basestocks having a viscosity of 4 to 8 or 6 $mm^2s^{-1}$ at 100° C.; or mixtures of Group IV basestocks with up to 80 mass % of Group I, II, III or V basestocks, for example mixtures of Group IV and III and/or V. Also advantageous is a mixture of Group III and V basestocks.

Especially preferred are Group IV basestocks, which have 60 to 75 mass % of a 6 $mm^2s^{-1}$ at 100° C. PAO and 40 to 25 mass % of a 4 $mm^2s^{-1}$ at 100° C. PAO as the only basestocks. They may, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures. PAO's are described in "Chemistry and Technology of Lubricants" edited by R. M. Mortier and S. T. Orszulik, published by Blackie (Glasgow) and VCH Publishers Inc. N.Y. (1992): Ch 2 Synthetic base fluids.

In each aspect of the present invention, it is preferred that the lubricating oil composition comprises a polyalphaolefin basestock; a dispersant; a calcium detergent, preferably a calcium alkyl salicylate; a ZDDP; an antioxidant; a pour point depressant; and viscosity modifier, each in an amount as specified herein.

When lubricating compositions contain one or more of the above-mentioned additives, each additive has typically been blended into the base oil in an amount which enables the additive to provide its desired function. Representative effective amounts of such additives, when used in diesel crankcase lubricants, are listed below. All the values listed are stated as mass percent active ingredient.

| | MASS % (Broad) | MASS % (Preferred) |
|---|---|---|
| (a) Dispersant | 1 to 10 | 1 to 7 |
| (b) Detergent | | |
| Ca detergent (expressed as Ca) | 0.05 to 0.60 | 0.15 to 0.55 |
| Mg detergent (expressed as Mg) | 0.05 to 0.3 | 0.05 to 0.15 |
| (c) Zinc dihydrocarbyl dithiophosphate (expressed as P) | 0 to 0.16 | 0.03 to 0.14 |
| (d) Anti-oxidant | 0 to 3 | 0 to 2.0 |
| (e) Pour Point Depressant | 0 to 2 | 0.0 to 1.0 |
| (f) Viscosity Modifier (expressed as solid polymer) | 0 to 2.0 | 0. to 1.5 |
| Corrosion Inhibitor | 0 to 0.2 | 0 to 0.1 |
| Anti-Foaming Agent | 0 to 0.005 | 0 to 0.004 |
| Supplemental Anti-wear Agents | 0 to 2.0 | 0 to 1.5 |
| (g) Mineral or Synthetic Base Oil | Balance | Balance |

All values in the table represent mass % active ingredient based on the final lubricating oil composition.

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably, all of the additives except for the viscosity modifier and the pour point depressant are blended into a concentrate that is subsequently blended into basestock to make a finished lubricant. Use of such concentrates is conventional. The concentrate will typically be formulated to contain the additive(s) in proper amounts to provide the desired concentration in the final formulation when the concentrate is combined with a pre-determined amount of base lubricant.

Preferably the concentrate additive package is made in accordance with the method described in U.S. Pat. No. 4,938,880. That patent describes making a premix of dispersant and metal detergents that is pre-blended at a temperature of at least about 100° C. Thereafter the pre-mix is cooled to at least 85° C. and the additional components are added.

The final formulations may employ from 2 to 15, preferably 5 to 10, typically 7 to 8, mass % of the additive package(s), the remainder being base oil.

EXAMPLES

The invention is further described, by way of illustration only, by reference to the following examples.

In the examples, unless otherwise stated, all percentages are reported as mass percent "a.i."; a.i refers to the active ingredient content of the additive component in diluent or carrier oil and "TBN" is Total Base Number.

In the examples, reference will be made to the accompanying drawing, the sole figure of which is a graph of base-blend viscosity (the x-axis) against wear (the y-axis) on which are plotted results for oil compositions of the invention and results for comparison oil compositions.

Four heavy duty diesel lubricating oil compositions were blended by methods known in the art: two of the compositions (Oils 1 and 2) were of the invention, and two of the compositions (Oils A and B) were comparison oils. Each composition was tested using the M11 engine test (high soot test performance).

The composition of each oil, each of which had CCS viscosity of less than 3500 mPa.s at −25° C., and the results of the tests are summarised in the Table following.

| | Oil, mass % | | | |
|---|---|---|---|---|
| | 1 | 2 | A | B |
| Components | | | | |
| (a) ashless dispersant | 3.78 | 3.85 | 3.85 | 3.85 |
| (b) detergent, on Ca basis | 0.48 | 0.38 | 0.48 | 0.38 |
| (c) ZDDP, on P basis | 0.12 | 0.15 | 0.15 | 0.15 |
| (d) ashless antioxidant | — | 0.37 | — | 0.37 |
| (e) pour depressant | 0.28 | 0.28 | 0.28 | 0.28 |
| (f) viscosity modifier, on solid polymer basis | 0.38 | 0.72 | 0.88 | 0.88 |
| (g) basestock from Group 1, II, III, IV or V | balance | balance | balance | balance |
| Properties | | | | |
| Base blend viscosity ($mm^2s^{-1}$ at 100° C.) | 9.3 | 8.5 | 8.1 | 8.1 |
| Sulfated ash (mass %) | 1.9 | 1.6 | 1.9 | 1.6 |
| TBN | 15.9 | 12.4 | 16.0 | 12.4 |
| Test Results | | | | |
| Crosshead wear (mg) (6.5/7.5/8.0 mg max*) | 4.6 | 5.2 | 14.7 | 13.2 |
| Oil filter differential pressure (Kpa) (79/93/100 Kpa max*) | 65 | 48 | 55 | 0 |
| Sludge merits (8.7/8.6/8.5 min*) | 8.7 | 9.1 | 9.2 | 9.2 |

-continued

| | Oil, mass % | | | |
|---|---|---|---|---|
| | 1 | 2 | A | B |

*1, 2 and 3 test average result limits, as defined in the CMA code of Practice

The above data show that Oils 1 and 2 (of the invention) met the requirements of the M11 test in all aspects, while Oils A & B failed in at least two of the aspects.

Referring to the drawing, the graph, which plots the crosshead wear results of Oils A, B, 1 and 2, shows that the crosshead wear decreases dramatically as the base-blend viscosity increases from 8.2 $mm^2s^{-1}$ and above, thereby demonstrating that the base-blend viscosity is a critical parameter for crosshead wear performance.

What is claimed is:

1. A low viscosity lubricating oil composition having a CCS viscosity less than 3500 mPa.s at −25° C. and a sulfated ash value of up to 2.0 mass %, based on the mass of the oil composition, which composition comprises an admixture of:

(a) 1 to 10 mass % of a dispersant, based on the mass of the oil composition;

(b) 0.05 to 0.60 mass % of elemental calcium or 0.05 to 0.30 mass % of elemental magnesium or both the calcium and magnesium in the corresponding amounts, based on the mass of the oil composition, wherein the calcium or magnesium or both calcium and magnesium are derived from one or more detergents;

(c) 0 to 0.16 mass %, based on the mass of the oil composition, of phosphorus;

(d) 0 to 5 mass % of an antioxidant, based on the mass of the oil composition;

(e) 0 to 2 mass % of a pour depressant, based on the mass of the oil composition;

(f) 0 to 2 mass % of a viscosity modifier, expressed as solid polymer, based on the mass of the oil composition; and (g) the balance a lubricating oil basestock selected from the group consisting of Group I, II, III, IV, V basestocks and any mixture thereof, with the proviso that when all the components selected from (a) to (g), which exhibit Newtonian behaviour, are admixed together, the base blend viscosity of the resulting admixture or composition is at least 8.2 $mm^2s^{-1}$ at 100° C.

2. The composition of claim 1 wherein the dispersant is a polyisobutenyl succinimide dispersant or a borated derivative thereof wherein the Mn of the polyisobutenyl is from 950 to 3,000.

3. The composition of claim 1 wherein the or each detergent is selected from a sulfonate, a phenate, a salicylate, a carboxylate and a mixture thereof.

4. The composition of claim 1 wherein component (b) is a mixture of a calcium sulfonate and a calcium phenate detergent.

5. The composition of claim 1 wherein component (b) is a calcium alkyl salicylate detergent.

6. The composition of claim 1 wherein the base blend viscosity is from 8.2 to 10 $mm^2s^{-1}$ at 100° C.

7. The composition of claim 1 wherein the lubricating oil basestock is a polyalphaolefin.

8. A method for preparing the lubricating oil composition of claim 1 comprising the steps of selecting components (a) to (g) so as to provide a composition or an admixture having a base blend viscosity, as defined in claim 1, of at least 8.2 $mm^2s^{-1}$ at 100° C., and thereafter admixing the components so as to provide a lubricating oil composition having a CCS viscosity of less than 3500 mPa.s at −25° C.

9. A method of lubricating an engine, which comprises supplying to the engine a lubricating oil composition of claim 1.

10. A method of meeting the requirements of a M11 cross-head wear engine test, which comprises using a lubricating oil composition as claimed in claim 1 in the test.

11. A low viscosity diesel engine lubricating oil composition having a CCS viscosity less than 3500 mPa.s at −25° C. and a sulfated ash value of up to 2.0 mass % which comprises an admixture of:

(a) 1 to 7 mass % of a lubricating oil ashless dispersant;

(b) a calcium or magnesium sulfonate, phenate or salicylate lubricating oil detergent, present in such an amount so as to provide 0.15 to 0.60 mass % elemental calcium and 0 to 0.15 mass % elemental magnesium in the composition;

(c) a zinc dihydrocarbyl dithiophosphate present in such an amount so as to provide 0.03 to 0.16 mass % phosphorus in the composition;

(d) 0 to 3 mass % of an ashless antioxidant;

(e) 0 to 2 mass % of a lubricating oil pour depressant;

(f) 0 to 2.0 mass % of a viscosity modifier, expressed as solid polymer; and (h) the balance a lubricating oil basestock selected from the group consisting of Group I, II, III, IV and V basestocks, and provided further that the base blend viscosity of all components exhibiting Newtonian behavior when admixed together, with the exception of the viscosity modifier and other components exhibiting non-Newtonian behavior, is at least 8.2 $mm^2s^{-1}$, at 100° C.

* * * * *